US005558062A

United States Patent [19]

De Minco et al.

[11] Patent Number: 5,558,062

[45] Date of Patent: Sep. 24, 1996

[54] INTEGRATED SMALL ENGINE CONTROL

[75] Inventors: Christopher M. De Minco, Honeoye Falls; Daniel B. O'Connell, Rochester; Michael T. Faville, Geneseo, all of N.Y.

[73] Assignee: General Motors Corporation, Detroit, Mich.

[21] Appl. No.: 316,427

[22] Filed: Sep. 30, 1994

[51] Int. Cl.[6] ..... F02D 41/14; F02D 43/04

[52] U.S. Cl. ..... 123/361; 123/399; 123/417; 123/478; 123/683

[58] Field of Search ..... 123/352, 361, 123/399, 413, 417, 478, 480, 683

[56] References Cited

U.S. PATENT DOCUMENTS 4,250,845 2/1981 Collonia ..... 123/361
4,418,673 12/1983 Tominari et al. ..... 123/399 X
4,524,745 6/1985 Tominari et al. ..... 123/399 X
4,552,116 11/1985 Kuroiwa et al. ..... 123/399 X
4,625,690 12/1986 Morita ..... 123/399 X
4,640,248 2/1987 Stoltman ..... 123/399
4,671,235 6/1987 Hosaka ..... 123/352
4,763,264 8/1988 Okuno et al. ..... 123/361 X
4,799,467 1/1989 Ishikawa et al. ..... 123/399

*Primary Examiner*—Tony M. Argenbright
*Attorney, Agent, or Firm*—Michael J. Bridges

[57] ABSTRACT

Small engine control is provided in which a manual selection of an engine operating level, such as from a positioning of a movable selector between a discrete number of selection settings is used to reference open-loop fuel, air, and ignition timing commands for application to respective actuators in accord with simple yet accurate and flexible engine control. Control precision, sensitivity, and stability are enhanced through engine parameter feedback control, wherein any of the open-loop air, fuel and ignition timing commands may be adjusted in accord with a difference between a feedback signal and a target value.

7 Claims, 4 Drawing Sheets

INTEGRATED SMALL ENGINE CONTROL

FIELD OF THE INVENTION

This invention relates to small engine control and, more particularly, to integrated electronic governor and power control of a small engine.

BACKGROUND OF THE INVENTION

Systems conventionally provided for control of small engines, such as engines of displacement less than about six hundred $cm^3$ or of output less than about twenty-five horsepower as commonly used in utility applications or in generator sets are typically dominated by mechanical control mechanisms, such as complex mechanical governors, linkages, carburetors, throttle bodies, valves and shafts, spring mechanisms, and cable assemblies. Such complex hardware may be difficult to calibrate, may require repeated service or adjustment, may be expensive to manufacture, may be unacceptably sensitive to changes in engine operating environment, and may offer limited controllability. Furthermore, such conventional control may not be easily adapted to respond to evolving engine performance and emissions expectations.

SUMMARY OF THE INVENTION

The present invention surmounts conventional small engine control shortcomings through a simple, reliable, flexible, yet highly controllable electronic control system for a small engine. More specifically, electronic control operates in response to an operator commanded engine operating point to position a simple, proven engine inlet air valve, to inject fuel to the engine through a simple fuel injector and to provide for engine ignition timing control. The operator command is categorized into one of a discrete number of engine operating levels each of which may, in an open loop embodiment, have associated with it a target air rate, a target fuel rate and a target ignition timing which may be referenced and used for establishing air, fuel and ignition timing commands to the respective inlet air valve, fuel injection system and ignition system.

In a further aspect of this invention, closed-loop electronic small engine control is provided in which engine parameter feedback information improves control stability and desensitizes the control to system disturbances and noise. The feedback information is applied through simple transfer functions which adjust engine control parameters, such as fuel, air and ignition timing parameters in response to variations in the feedback parameters away from target values. The transfer function may be heuristically derived or may be derived through more sophisticated control techniques, such as through application of principles of classical or modern control theory.

In yet a further aspect of this invention, integrated control of air, fuel and ignition timing may be provided in a hierarchical engine control strategy for closed-loop engine speed control. Small deviations of an engine control parameter, such as engine speed, away from a target value may be compensated in this hierarchical approach through ignition timing control. In the event the authority of such ignition timing control is exceeded, such as for relatively large parameter deviations away from the target value, fuel control may provide the compensation. The compensation may be provided through inlet air rate control under certain operating conditions, such as in the event the authority of both ignition timing control and fuel control is exceeded.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
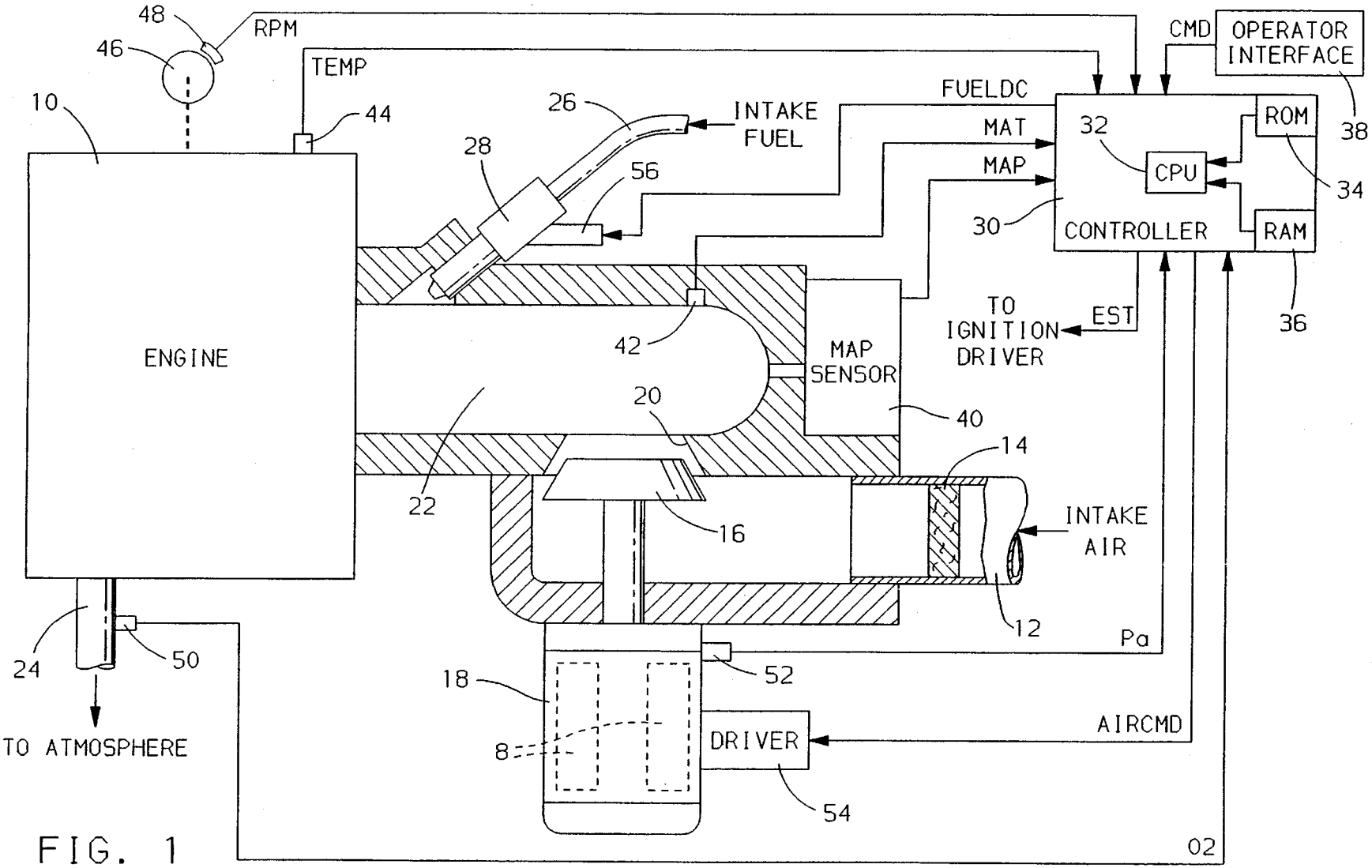
FIG. 1 schematically illustrates hardware used for small engine control in accord with the preferred embodiment of this invention.

Referring to FIG. 1, small engine 10, such as an internal combustion engine of conventional design as is typically applied in utility applications or to generator sets , is provided intake air through air intake conduit 12 in which is disposed conventional air filter 14 for filtering impurities out of intake air. The filtered intake air is metered into an intake manifold 22 by conventional valve 16, such as a conventional solenoid valve pintle actuated by conventional solenoid actuator 18 or conventional linear actuator. The valve pintle moves into and out of an orifice of the intake manifold housing 20 so as to provide a varying degree of opening of the orifice for admission of a varying inlet air quantity in accord with a desired engine operating point. Intake fuel, such as conventional gasoline, is provided substantially at a known pressure from a fuel supply via fuel line 26 to a conventional fuel injector 28 which is periodically actuated during engine operation to administer a fuel quantity into the intake air stream for mixing in the intake manifold 22 and admission into the cylinders of engine 10. Fuel injector 28 is presented in FIG. 1 merely as an example of the manner of fuel delivery to engine 10 of the present embodiment. Additional fuel injectors may be included beyond the fuel injector 28, and may be controlled for fuel delivery to engine 10 in the manner described herein for the injector 28. The air-fuel mixture is combusted through engine operation and the combustion gasses exhausted from engine 10 into exhaust gas conduit 24 and to the atmosphere. Control of the timing and quantity of air and fuel admitted to the engine 10 is provided in accord with this embodiment by controller 30, which may be a conventional eight bit single-chip microcontroller of conventionally simple design having such elements as a central processing unit CPU 32, a read only memory unit ROM 34 and a random access memory unit RAM 36**. Alternatively, such control may be provided by hybrid electronic circuitry.

Controller operations are provided in accord with this embodiment to read input signals indicating values of operating parameters and to process, in accord with a command CMD from an operator interface 38, fuel and air commands to be issued to the fuel injector driver 56 and the solenoid valve driver 54. Operator interface 38 may be a conventional lever having a discrete number of positions associated with a discrete number of desired engine operating levels. Operator interface 38 may further include an ignition key receptacle for receiving an appropriately encoded ignition key. When the ignition key receptacle is rotated or otherwise positioned by an engine operator to a "start" position, a start command is provided to controller 30 by the operator interface 38. Other commands issued from the operator interface 38 may include a number of varying engine operating levels including a low commanded engine operating level corresponding to a low engine speed and load, a medium commanded engine operating level corresponding to an intermediate engine speed and load, and a high commanded engine operating level associated with a high engine speed and load. Other interface information relating to the engine operator's desired engine operating point as may be conventionally used in small engine control, may be provided to the controller 20 from interface 38 in accord with this invention. Electrical signal CMD is presented in FIG. 1 as the signal containing the interface information provided to controller 30. Other information received by controller 30 in accord with various embodiments of this invention may include, but is not intended to be limited to, a manifold absolute pressure signal MAP from a conventional pressure transducer 40 exposed to the pressure of intake manifold 22, manifold air temperature signal MAT from a conventional temperature sensor such as a conventional thermistor or thermocouple 42 exposed to air in intake manifold 22, a signal TEMP indicating engine temperature, such as from an engine block or engine coolant temperature sensor 44, an engine speed signal RPM indicating the rate of rotation of an engine output shaft 46, such as a conventional engine crankshaft, which is transduced by conventional variable reluctance or hall affect sensor 48, engine exhaust gas oxygen content signal O2 issued by conventional zirconium oxide or other conventional oxygen sensor 50 disposed in the engine exhaust gas conduit 24, actual intake air valve position signal Pa issued by conventional potentiometric position sensor, or conventional Hall effect sensor or other conventional position sensing device 52. Such input signals indicating engine operating conditions as well as other conventionally-available signals indicating general operating parameters, may be passed to controller 30 for indicating various engine operating conditions. Through execution of a number of engine control routines, to be described, controller 30 processes the number of input signals and issues a number of actuator control signals to provide for engine control. For example, control signal FUELDC is issued by controller periodically to conventional fuel injector driver 56 such as a high current driver for driving at least one conventional fuel injector for admitting fuel to the engine cylinders. Controller 30 likewise generates an air inlet rate command AIRCMD to driver 54 which may be a conventional motor driver circuit for controlling motor 18. The driver may provide for a level of current flow corresponding to the magnitude of AIRCMD through an inductive coil 8 of motor 18, for generating an electromagnetic field that influences the linear position of pintle 16, wherein pintle linear position provides a corresponding degree of restriction of intake air passing through intake manifold housing orifice 22. Alternatively, actuator 18 may be a conventional stepper or DC motor driven in accord with a controlled current to motor windings provided by driver 54 which, may be a motor driver, such as a conventional full or partial H-bridge driver configuration which provides for precise bi-directional current control through the motor windings, as is generally understood in the art. controller 30 may further provide an ignition control command EST to an ignition driver for driving at least one engine spark plug to ignite the air-fuel mixture metered to the engine. The command EST controls the timing of the ignition of the at least one spark plug to vary engine torque. A spark timing control function responsive to engine speed error may be used to generate the value for EST, which is periodically updated and issued to the ignition driver at appropriate times while the engine is operating.

Beyond the control of injector driver 56, motor driver 54, and ignition driver (not shown), controller 30 may carry out other engine control and diagnostic functions, to be described. Accordingly, in the preferred embodiment, simple engine control through a simple, linear solenoid valve 18 and simple fuel injector 28 may be provided using a simple single-chip microcontroller 30. Such control provides the flexibility of adding information from a number of sensors for sensing engine operating conditions, such as some of the sensors illustrated in FIG. 1, wherein the controller 30 may then be responsive to such input signal information for more precisely and robustly controlling the engine 10 in accord with engine performance and emissions goals.

Figure 2:
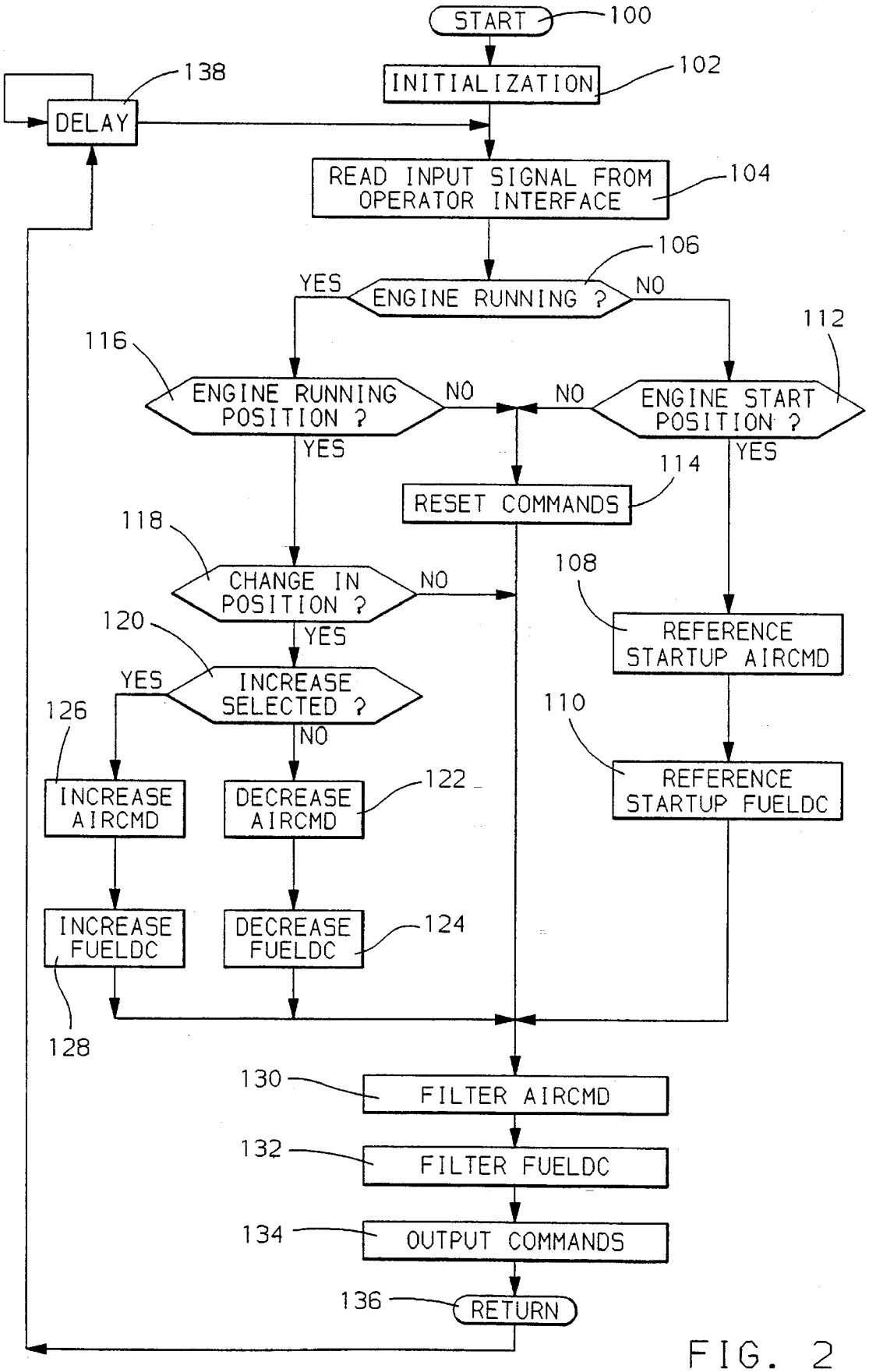
FIG. 2 is a block diagram illustrating a sequence of computer operations used to provide the engine control of the preferred embodiment of this invention.

Among the engine operations executed by controller 30 for providing fuel and air control to the engine 10 of FIG. 1, the routine of FIG. 2 is illustrated which is initiated at a step 100 upon rotation of the ignition key receptacle of operator interface 38 of FIG. 1 away from an "off" position corresponding to engine 10 and controller 30 being off, to an "on" position corresponding to a desired, operator initiated start of engine control operations in accord with this embodiment. The routine of FIG. 2 generally provides an open-loop engine control function in accord with the simple, yet accurate and responsive engine control of the present invention. The routine may repeatedly execute certain of its steps while the ignition receptacle of operator interface 38 of FIG. 1 is rotated away from the "off" position to provide for engine control. Alternatively, the routine of FIG. 2 may be executed at controller start up, and then may be periodically re-executed starting at the step 104, to be described, upon occurrence of an engine timer event or an engine cylinder event. Following entry at the step 100, the routine proceeds to provide for system initialization at a step 102, for example as required to initiate controller 30 operations following a period during which the controller was disabled, such as by resetting pointers and counters used for controller operations and by transferring data from read only memory ROM 34 to random access memory RAM 36 and for carrying out other conventional microcontroller initialization functions.

The routine next reads input signal information from the operator interface 38 of FIG. 1 at the step 104, so as to determine the engine operating point desired by the engine operator. As described, such information may be in the form of command signal CMD provided from operator interface 38 to controller 30 of FIG. 1, including information on the rotational position of an ignition receptacle and the desired engine operating level such as may be indicated by the position of a movable lever or switch as displaced by the engine operator.

The routine next proceeds to determine if the engine is running at a step 106. The engine may be determined to be running by analyzing CMD or an output from sensor 48 of FIG. 1 indicating that engine output shaft 46 is rotating at a rate above a threshold rate indicating an operating engine. Other means of indicating engine operation may likewise be interrogated at the step 112, such as by analyzing the signal MAP and determining the engine 10 to be running when MAP has decreased to a low pressure value indicating engine suction.

Figure 4:
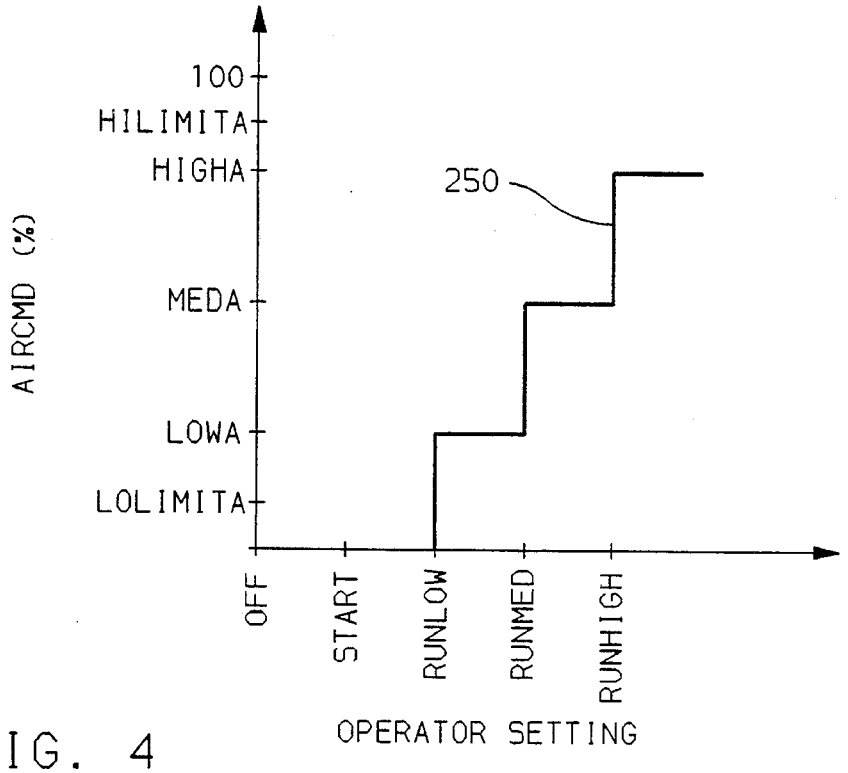
FIGS. 4 and 5 illustrate relationships between operator command values and open-loop control commands in accord with the preferred embodiment of this invention.

If the engine is not determined to be running at the step 106, a step 112 is executed to determine if engine starting is currently being attempted as indicated by the ignition key receptacle being rotated to a "start" position, as described. The engine starting position electrically induces engine cranking through a commercially available conventional starter circuitry, wherein an appropriate engine air/fuel ratio is desired to provide for rapid ad reliable engine startup during such cranking. If the ignition key receptacle is determined to be at the starting position at the step 112, the routine proceeds to steps 108 and 110 to reference open-loop start-up engine air and fuel commands. The start-up air and fuel commands may be referenced from predetermined command schedules stored in controller read only memory ROM 34 of FIG. 1 in the form of conventional look-up tables. Generally, the air and fuel commands stored in the schedules may be referenced in accord with information provided from operator interface 38 in the form of a desired operating state of the engine 10. For example, curve 250 of FIG. 4 represents a relationship between air command AIRCMD, expressed as a percentage of maximum airflow into the intake manifold 22 of FIG. 1, and an operator setting communicated by the operator via interface 38, as described. A discrete number of operator settings may be available, such as an off setting, a start setting and low, medium and high run settings. The operator may select from these or from additional discrete settings through positioning of a switch or lever of operator interface 38. Curve 250 illustrates that a value of 0 for AIRCMD, corresponding to a substantially closed pintle 16, will be referenced if the operator setting is "off." AIRCMD will likewise be zero for a "start" setting, to provide a rich air/fuel ratio during engine cranking (as fuel is injected to the engine 10 during engine cranking) to provide rapid and reliable engine startup. Following an engine start-up, when engine cranking is complete, the operator may select one of a discrete number of run levels. For example, a RUNLOW operator setting corresponds in this embodiment to an AIRCMD of LOWA, which is about ten percent of full airflow into manifold 22 (FIG. 1). A RUNMED operator setting corresponds to an air command of MEDA which may be about 40% of full airflow into engine 10. Finally, an operator setting of RUNHIGH may correspond to an air command HIGHA which may be approximately 80% of full airflow into engine 10. Furthermore, a high limit HILIMITA may be established as an upper bound limit on the amount of airflow allowed past the pintle 16 of FIG. 1 into engine 10. Such limit may be established to prevent saturation of driver 54 or in accord with specifications of motor 18. The high limit A may be above HIGHA and yet below the full open 100% air command of FIG. 4.

Figure 5:
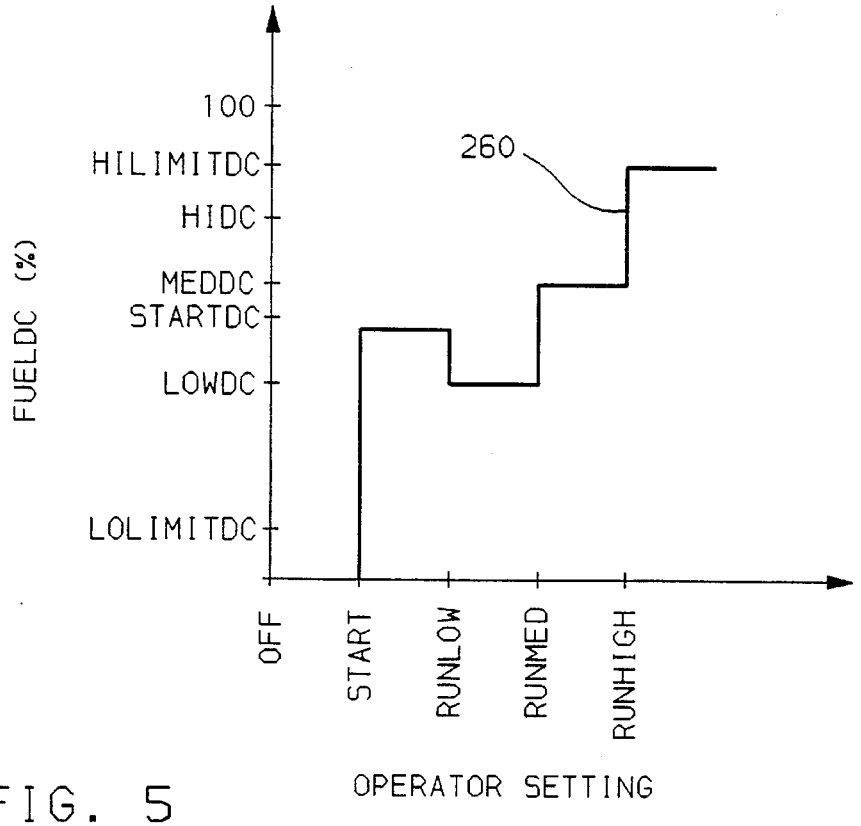

Corresponding to the air command schedule of FIG. 4, a small engine load fuel command schedule is represented through curve 260 of FIG. 5 in which a discrete number of operator settings, such as the settings described in the FIG. 4, have associated with them a small-load fuel duty cycle command FUELDC. FUELDC is the amount of injection time during which injector 28 or additional injectors that may be included for conventional fueling of engine 10, is opened during or slightly before an intake event of an active engine cylinder to meter pressurized fuel ultimately to the cylinder under small engine loads. A FUELDC value of 100 percent represents a maximum tolerable on-time, corresponding to a maximum fuel charge that could be input to an engine cylinder for a single engine cylinder event. A FUELDC value of zero represents no injection.

As illustrated by curve 260, for an operator setting of "off," FUELDC is zero. For a "start" setting FUELDC is set to a value STARTDC, which may be about twenty percent duty cycle, to provide a rich air/fuel ratio condition in engine 10 corresponding to the zero commanded air from the schedule illustrated by curve 250 of FIG. 4. Following an engine start, if the operator setting is "RUNLOW," FUELDC is set to a value LOWDC, which may be about seven percent duty cycle. For a setting of "RUNMED," FUELDC is set to a value MEDDC, which may be about twenty-five percent duty cycle, and for a setting "RUN-HIGH," FUELDC may be set to HIDC, which may be about thirty-five percent duty cycle.

An upper duty cycle limit HILIMITDC is established as a duty cycle upper limit above the value HIDC yet below the maximum duty cycle of 100 percent. A low limit LOLIMITDC is likewise provided between zero duty cycle and LOWDC. Such limits constrain the duty cycle command to a reasonable range within which the driver 56 and injector 28 operate predictably and controllably, as is generally understood in the art.

Returning to FIG. 2, when the ignition key receptacle of interface 38 (FIG. 1) is determined to be at a start position at the step 112, a start-up value for AIRCMD of zero percent is referenced at a step 108 from controller ROM 34, such as may be stored in the form of a conventional lookup table, as described. A fuel commanded duty cycle FUELDC is next referenced at a step 110 from controller ROM 34, such as may be stored in the form of a conventional lookup table incorporating the information from curve 260 of FIG. 5. As described the value for FUELDC of STARTDC, which may be about twenty percent duty cycle is referenced for engine startup, to provide a rich air/fuel ratio condition for rapid and reliable engine starting. The routine next proceeds to a step 130, to be described.

Returning to the step 112, if engine starting is not currently indicated by the CMD information from interface 38, air and fuel commands are reset to zero to discontinue fuel and air control to the engine, and the routine then proceeds to the step 130, to be described. Returning to the step 106, if the engine is determined to be running, the input command CMD from the operator interface is examined at a step 116 to determine if the operator has selected an engine running position, such as the low, medium, or high running positions described in the FIGS. 4 and 5. If an engine running position has not been selected by the operator as determined at the step 116, the air and fuel commands are reset at the step 114 to substantially zero commands to terminate engine operation. However, if an engine running position has been selected as determined at the step 116, a step 118 is executed to determine if the current run position is different than the most recent prior run position. If no change in position is identified between the present control cycle and a prior control cycle, such as the prior cycle corresponding to the most recent prior execution of the routine of FIG. 2, then no change in air and fuel control commands is assumed to be necessary for engine control, and the routine proceeds to the step 130, to be described. However, if a command change is identified at the step 118, the routine moves to a step 120, to determine if the change was an increase in desired engine operating level. If such an increase was selected by the vehicle operator as detected at the step 120, the routine proceeds to steps 126 and 128 to increase the air command AIRCMD and the fuel duty cycle FUELDC to accommodate the operator selection of an increased engine operating level. The increase in AIRCMD provided at the step 126 may be carried out by referencing an AIRCMD value in the described conventional look-up table corresponding to the curve 250 of FIG. 4 as the AIRCMD value corresponding to the current operator setting. For example, if a RUNLOW setting is selected, LOWA will be referenced from the lookup table as the new air command. In an alternative embodiment, AIRCMD may be increased at the step 126 by moving from the current air command setting to the adjacent higher discrete air command setting, to provide simple yet responsive air control to engine 10.

After increasing AIRCMD at the step 126, the fuel duty cycle FUELDC is increased at the step 128 by referencing a fuel duty cycle corresponding to the current operator setting using a conventional look-up table including the information from curve 260 of FIG. 5, as described. Alternatively, the increase in FUELDC of step 128 may be carried out by moving from the current fuel duty cycle setting to an adjacent higher duty cycle setting along the discrete number of settings, such as the settings illustrated in the described FIG. 5. Following the increase in fuel duty cycle, the step 130 is executed, to be described.

Returning to the step 120, if an increase is not selected by the vehicle operator, a decrease in the engine operating level is assumed to have been requested and the routine proceeds to a step 122 to decrease AIRCMD and to a step 124 to decrease FUELDC so as to properly respond to the operator position change determined at the step 118. The AIRCMD decrease may be provided by referencing the AIRCMD value corresponding to the operator command setting, for example using information from the lookup table corresponding to curve 250 FIG. 4, or by moving from the current AIRCMD value to the adjacent lower command value along the range of discrete AIRCMD values, as in the manner described for the increase in AIRCMD at the step 126. Likewise, the decrease in FUELDC of the step 122 may be provided by directly referencing the FUELDC value corresponding to the current operator setting, or by moving from the current FUELDC value to the adjacent lower FUELDC value along the range of such values, as in the manner described for the increase in FUELDC at the step 128. After resetting the air and fuel commands at the described step 114, or after determining that no change in position was required at the step 118, or after referencing a start-up fuel duty cycle at the step 110, or after adjusting air and fuel commands through the steps 122–128, the air and fuel commands may be filtered at steps 130 and 132 to improve fuel and air control stability and smoothness, and in accord with any driver or actuator control specifications, as is generally understood in the art. Such filtering may be provided through conventional lag filter processes including information on past and present air and fuel commands. The air command is filtered at the step 130 through a conventional lag filter process and then the fuel duty cycle is filtered through a conventional lag filter process at the step 132 after which the filtered commands are output to the respective actuators at the step 134. The filtered air command is output to driver 54 for driving inductive coil or other actuator device 18 for pintle positioning within the orifice of housing 20. The filtered duty cycle is output to driver 56 for driving at least one fuel injector 28. The timing of the driving of the fuel injector 28 may be fixed in time or may vary with engine speed, so that fueling is provided only when needed prior to cylinder combustion events. The timing of delivery of any change in the air command to driver 54 may correspond to the timing of the change in the fuel duty cycle applied to driver 56 so that engine air/fuel ratio may remain at a constant desirable value in accord with peak engine performance and efficiency and low engine out emissions. After outputting the commands at the step 134, the routine proceeds to a step 136 where it is directed to return, through a delay loop 138 to restart certain operations of the routine of FIG. 2, such as starting at the step 104 at which input signal information from the operator interface 38 of FIG. 1 is read. After reading the input signal information at the step 104 following the delay period 138, such input information is acted on by again carrying out the operations of the routine of FIG. 2 including steps 106–134. The delay loop 138 may include background operations such as conventional diagnostic and maintenance operations to insure reliable controller functioning and reliable engine operations. The time duration of the delay established at the loop 138 may be set up in accord with the desired responsiveness and throughput capacity of the controller 30 of FIG. 1. In this embodiment, the delay established at the loop 138 is of sufficient time duration to allow for air and fuel commands to be updated through the operations of FIG. 2 approximately once every five milliseconds.

The specific open-loop operations of the routine of FIG. 2 for controlling inlet air and fuel to the engine 10 of FIG. 1 are provided as merely one example of how such simple yet efficient and reliable operations may be carried out in accord with this invention. In a further example, engine ignition timing may be controlled in an open-loop manner along with the described air and fuel control wherein ignition timing may be fixed, or may vary in accord with changes in the operator-requested engine operating level. Furthermore, other routines may be substituted for that of FIG. 2 in accord with this invention for providing such control including closed-loop routines in which various sensors may be applied for engine parameter sensing such as the sensors 40, 42, 44, 48, 50, and 52 of FIG. 1 to exploit information provided by such sensors for closing the loop around certain engine parameters or control parameters to provide for slightly more expensive yet more reliable and robust closed-loop control operations. For example, information provided by MAP sensor 40 may be used to improve engine control by indicating engine intake airflow information and engine load information for use in engine control. Likewise, engine temperature information, manifold air temperature information, engine speed information, engine exhaust gas oxygen content information and solenoid position information may be used by controller 30 in accord with this invention for providing closed-loop engine control.

Figure 3:
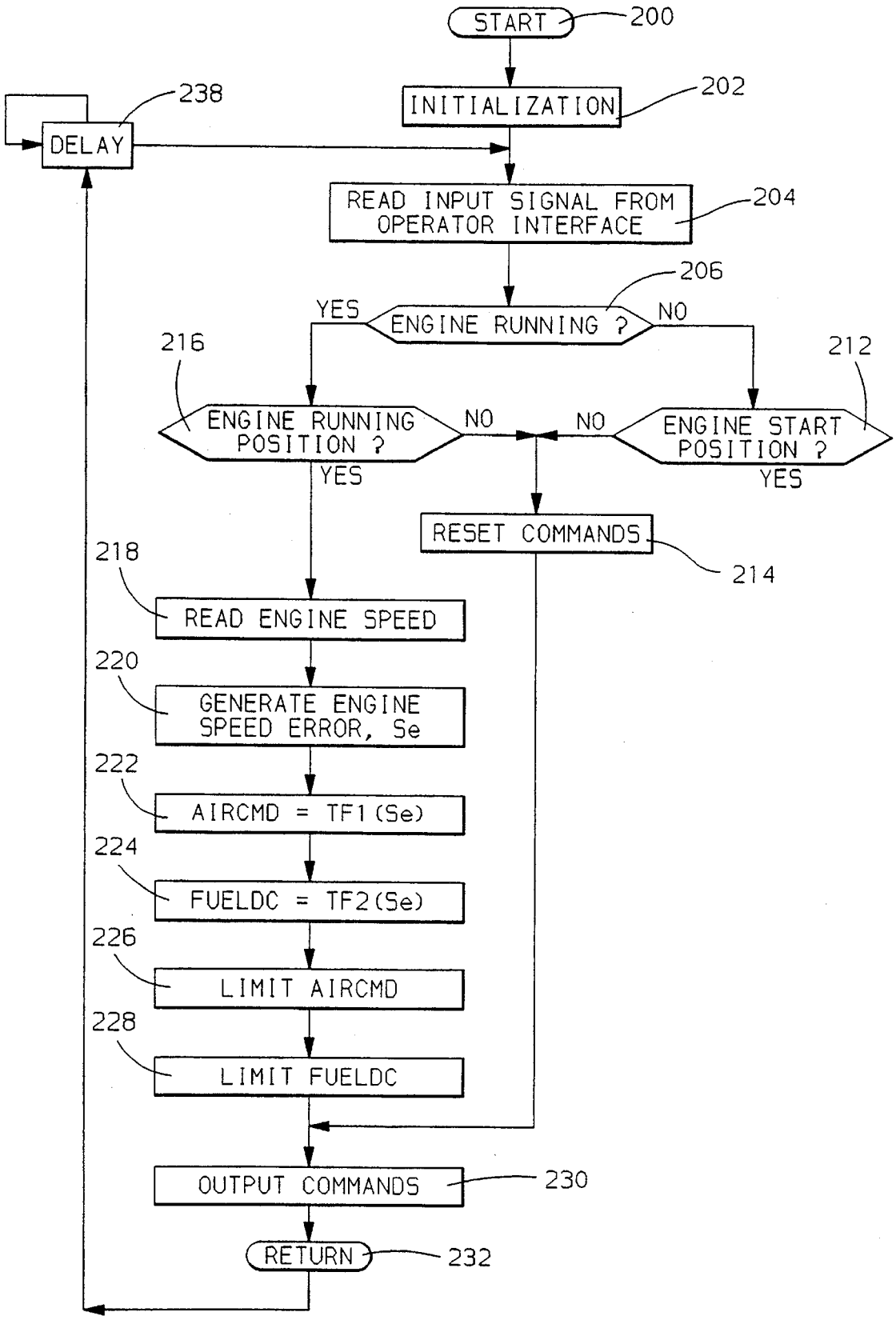
FIG. 3 is a block diagram illustrating a sequence of computer operations used to provide the engine control of an alternative embodiment of this invention.

One example of such closed-loop control within the scope of this invention is illustrated through the sequence of operations of FIG. 3 in which engine speed information from signal RPM is applied in closed-loop air and fuel control. For example, the conventional variable reluctance or hall affect sensor 48 providing output signal RPM to controller 30 of FIG. 1 may be used in the embodiment including the operations of FIG. 3 to determine the rate of rotation of an engine output shaft 46 so as to indicate not only engine angular position for fuel and air timing purposes, but also to indicate the engine output speed. The sequence of operations of FIG. 3 are carried out in one alternative embodiment within the scope of this invention as follows. The routine of FIG. 3 is initiated at a step 200 following a start-up command such as the start-up command that initiated the routine of FIG. 2. The routine of FIG. 3 proceeds from the step 200 to carry out initialization operations at the step 202, for example in the manner described for step 102 of FIG. 2. Input signal information is next read from the operator interface 38 of FIG. 1 at a step 204 in the manner described for step 104 of FIG. 2. Likewise, the steps 206–216 are executed as described for the respective steps 106–116 of FIG. 2. However, at the step 216, if the operator has selected an engine running position, the routine proceeds to carry out steps 218–230 to provide for closed-loop air and fuel control operations around engine speed as follows. A first step 218 is executed at which input signal RPM is read. An engine speed error Se is next generated at the step 220 such as by subtracting a desired engine speed as may be referenced as a predetermined function of the input signal CMD read at the step 202 from the read engine speed RPM as determined at the step 218. This engine speed error Se is the difference between the desired speed as indicate by the operator setting and the actual engine speed and may indicate a variation in engine output performance from a desired performance. Such variation forms the basis for correction of air and fuel commands to the engine so as to drive the actual engine speed toward the desired engine speed. After generating engine speed error Se at the step 220, the air command AIRCMD is generated at a step 222 by applying the engine speed error to a transfer function TF1. The transfer function TF1 may correspond to a conventional control transfer function such as developed through application of classical or modern control techniques, so as to operate on the control parameter Se to drive Se toward zero in a controlled manner. For example, TF1 may be a conventional, proportional-plus-integral-plus-derivative transfer function responsive to Se in accord with classical control techniques. Alternatively, TF1 may be other control functions generally recognized as conventional by those skilled in the art, wherein such control functions are designed to controllably reduce engine speed error in a responsive manner. After generating AIRCMD via TF1, the routine determines a fuel duty cycle FUELDC by applying engine speed error Se to a transfer function TF2 at a step 224. Like the transfer function TF1 described at step 222, the transfer function TF2 may include classical or modern or other control principles designed to rapidly reduce engine speed error toward zero in a stable manner. TF2 may employ proportional-plus-integral-plus-derivative control techniques or other modern control techniques such as state feedback techniques or more advanced techniques that are conventionally available to derive a fuel-based control command from the engine speed error.

After determining the air command and the fuel duty cycle at the respective steps 222 and 224, the air command is limited in accord with a predetermined air command range at step 226, for example so as to not overdrive the driver 54 of FIG. 1 or overposition the solenoid 18 of FIG. 1. For example, air command may be limited to a predetermined difference away from a most recent prior air command or may be limited to a range of air commands such as the range defined by LOLIMITA and HILIMITA of FIG. 4. Air command is limited to such range at the step 226 by comparing air command to the preferred air command range and by limiting it to any exceeded extreme of the range, or by limiting change in air command to a predetermined change limit value.

After limiting the air command, the routine proceeds to limit the fuel duty cycle at a step 228 to a predetermined fuel duty cycle range such as a range established as a predetermined difference away from a prior most recent fuel duty cycle command, or such as to a range defined by the boundary values LOLIMITDC and HILIMITDC as illustrated in FIG. 5. Fuel duty cycle is limited at the step 228 to prevent overdriving or underdriving the driver 56 or the injector or injectors 28 of FIG. 1 and to allow for smooth fuel control to the engine 10. After limiting the fuel duty cycle at the step 228, or after resetting commands at the step 214 such as in the manner described in step 114 of FIG. 2, or after referencing the start-up fuel duty cycle at the step 210 such as in the manner described for the step 110 of FIG. 2, the routine proceeds to output the fuel and air commands at a step 230, such as in the timed manner described for the step 134 of FIG. 2 to respective drivers 54 and 56 of FIG. 1. After outputting the commands, the routine returns via step 232 to a delay loop 238 corresponding in operation generally to the delay loop 138 of FIG. 2. After the delay imposed by delay loop 238 is complete, the routine proceeds to the step 204 to again analyze the input signal CMD from the operator interface 38 of FIG. 1 and to respond to the input signal through the operation of the steps 206–230 as described.

In an alternative embodiment of this invention, the control operations of FIG. 3 may include engine ignition timing control operations, wherein a transfer function may be developed describing the relationship between engine spark timing and engine speed error Se, for example to provide engine output torque compensation to reduce Se toward zero for small values of Se. When ignition timing compensation runs out of authority, such as for larger values of Se, the fuel transfer function TF2 may be established to vary the delivered fuel quantity to the engine to provide engine torque compensation. When fuel control authority reaches its limit, the air transfer function TF1 may be established to vary the metered intake air quantity to the engine to provide engine torque compensation.

The closed-loop control operations generally described through the steps of FIG. 3 may, in alternative embodiments of this invention, include other engine input signals in addition to or as a replacement for the engine speed input signal relied on in the closed-loop operations of FIG. 3. For example, through simple variations in the transfer functions TF1 and TF2 of steps 222 and 224 and by reading a different input signal and generating a different parameter error signal at the respective steps 218 and 220, other engine input signals or additional engine input signals may be used and the control loop closed therearound to provide for improved engine control in accord with this invention. One such example relies on input signal O2 as an indication of actual engine air/fuel ratio, wherein signal O2 is read at the step 218, and air/fuel ratio error generated at the step 220, and fuel and air commands adjusted in response to the error at the steps 222 and 224 through conventional control techniques.

The preferred embodiment for explaining this invention is not to be taken as limiting or restricting this invention since many modifications may be made through the exercise of skill in the art without departing from the scope of this invention.

The embodiments of the invention in which a property or privilege is claimed are described as follows:

1. A control system for a small engine having an inlet air passage, comprising:

a movable engine operating level selector;

a sensor for sensing the selector position;

an engine command schedule consisting of sets of engine control commands, wherein each set corresponds to at least one selector position;

an ignition timing controller for timing engine ignition events in accord with the set of engine control commands corresponding to the sensed selector position;

an engine air control valve for controlling a degree of restriction of the inlet air passage in accord with the set of engine control commands corresponding to a sensed selector position; and at least one fuel injector for metering a quantity of fuel to the engine in accord with the set of engine control commands corresponding to the sensed selector position.

2. A control method for small engines in which an engine inlet air rate, engine ignition timing, and inlet fuel rate are controlled in accord with a setting of a selection mechanism, comprising the steps of:

establishing a schedule of discrete engine operating points, wherein each of the operating points is characterized by a predetermined engine inlet air command corresponding to an inlet air rate to the engine, a predetermined ignition timing value, and a predetermined engine fuel command corresponding to an inlet fuel rate to the engine;

mapping each of the points of the established schedule to a corresponding setting of the selection mechanism;

determining a present setting of the selection mechanism;

referencing from the established schedule the engine inlet air command, the ignition timing value and the engine fuel command corresponding to the present setting;

controlling an inlet air valve position in accord with the referenced engine inlet air command to admit air to the engine substantially at the inlet air rate corresponding to the referenced engine inlet air command;

controlling at least one fuel injector in accord with the referenced engine fuel command to admit fuel to the engine substantially at the inlet fuel rate corresponding to the referenced engine fuel command; and controlling engine ignition timing in accord with the referenced engine ignition timing value to ignite the inlet fuel and air at an ignition timing substantially corresponding to the referenced engine ignition timing.

3. A control method for small engines in which an engine inlet air rate and inlet fuel rate are controlled in accord with a setting of a selection mechanism, comprising the steps of:

establishing a schedule of discrete engine operating points, wherein each of the operating points is characterized by a predetermined engine inlet air command corresponding to an inlet air rate to the engine and a predetermined engine fuel command corresponding to an inlet fuel rate to the engine;

mapping each of the points of the established schedule to a corresponding setting of the selection mechanism;

determining a present setting of the selection mechanism;

referencing from the established schedule the engine inlet air command and the engine fuel command corresponding to the present setting;

sensing a value of a predetermined engine operating parameter;

establishing a target value of the predetermined engine operating parameter;

determining a difference value representing the deviation of the sensed value away from the established value;

adjusting the referenced engine inlet air command as a first predetermined function of the determined difference value;

adjusting the referenced engine fuel command as a second predetermined function of the determined difference value;

controlling an inlet air valve position in accord with the referenced engine inlet air command to admit air to the engine substantially at the inlet air rate corresponding to the referenced engine inlet air command; and controlling at least one fuel injector in accord with the referenced engine fuel command to admit fuel to the engine substantially at the inlet fuel rate corresponding to the referenced engine fuel command.

4. The method of claim 3, wherein the predetermined engine operating parameter is engine speed.

5. The method of claim 3, wherein the predetermined engine operating parameter is engine air/fuel ratio.

6. The method of claim 3, wherein the predetermined engine operating parameter is engine intake manifold absolute air pressure.

7. A small engine control method in which a small engine output level is varied in accord with a desired output level, comprising the steps of:

establishing a startup engine output level having a predetermined startup engine inlet air rate and a predetermined startup engine inlet fuel rate;

admitting air and fuel into the engine in accord with the established startup engine output level;

sensing a change in the desired output level;

detecting a desired output level increase when the sensed change corresponds to an increase in the desired output level;

increasing the engine inlet air rate by a predetermined air increase amount and increasing engine inlet fuel rate by a predetermined fuel increase amount upon detecting the desired output level increase; and decreasing the engine inlet air rate by a predetermined air decrease amount and decreasing engine inlet fuel rate by a predetermined fuel decrease amount when the change is sensed and the desired output level increase is not detected.

* * * * *